United States Patent [19]

Branovich et al.

[11] Patent Number: 5,022,883

[45] Date of Patent: Jun. 11, 1991

[54] METHOD OF MAKING A LONG LIFE HIGH CURRENT DENSITY CATHODE FROM ALUMINUM OXIDE AND TUNGSTEN OXIDE POWDERS

[75] Inventors: Louis E. Branovich, Howell; Gerard L. Freeman, Freehold; Donald W. Eckart, Wall; Bernard Smith, Ocean, all of N.J.

[73] Assignee: The United States of America as represented by the Secretary of the Army, Washington, D.C.

[21] Appl. No.: 609,537

[22] Filed: Nov. 6, 1990

[51] Int. Cl.[5] ..... H01J 19/06

[52] U.S. Cl. ..... 445/50; 313/346 DC

[58] Field of Search ..... 445/51, 50; 313/346 DC

[56] References Cited

U.S. PATENT DOCUMENTS

| | | | |
|---|---|---|---|
| 1,720,654 | 7/1929 | Wein | 445/51 |
| 1,921,065 | 8/1933 | Becker | 445/51 |
| 2,128,270 | 8/1938 | Spanner et al. | 445/51 |
| 2,509,702 | 5/1950 | Stanier | 313/346 DC |
| 2,543,728 | 2/1951 | Lemmens et al. | 313/346 DC |

*Primary Examiner*—Richard K. Seidel
*Assistant Examiner*—Jeffrey T. Knapp
*Attorney, Agent, or Firm*—Michael Zelenka; Roy E. Gordon

[57] ABSTRACT

A long life high current density cathode is made from a mixture of aluminum oxide and tungsten oxide powders by processing the powders into a fused powder, adding barium hydride to the fused powder, inverting the fused powder and heating to decompose the barium hydride and obtain barium metal.

7 Claims, No Drawings

METHOD OF MAKING A LONG LIFE HIGH CURRENT DENSITY CATHODE FROM ALUMINUM OXIDE AND TUNGSTEN OXIDE POWDERS

GOVERNMENT INTEREST

The invention described herein may be manufactured, used, and licensed by or for the Government for governmental purposes without the payment to us of any royalty thereon.

FIELD OF INVENTION

This invention relates in general to a method of making a long life high current density cathode and in particular to a method of making such a cathode from a mixture of aluminum oxide, $Al_2O_3$ and tungsten oxide, $WO_3$ powders.

BACKGROUND OF THE INVENTION

It is known in the cathode fabrication art that $Al_2O_3$ and $WO_3$ react in a 1:3 molar ratio to form $Al_2(WO_4)_3$ at temperatures greater than 900° C. It is also known in the cathode fabrication art that the presence of $Al_2(WO_4)_3$ can be detected in a tungsten billet that has been impregnated with the well known impregnant, $Ba_3Al_2O_6$. The $Al_2(WO_4)_3$ and the impregnant $Ba_3Al_2O_6$ however react with each other to form $BaAl_2O_4$ and $BaWO_4$ without the formation of free barium metal. This is significant since it is the free barium metal that is responsible for electron emission in the aforementioned impregnated cathode. It is believed that the formation of $Al_2(WO_4)_3$ acts as a deterrent to barium metal formation, and that electron emission is reduced. This occurs in conventional cathodes such as a porous billet of tungsten impregnated with $Ba_3Al_2O_6$.

SUMMARY OF THE INVENTION

The general object of this invention is to provide an improved method of making a long life high current density cathode. A more particular object of the invention is to provide such a method in which conventional impregnants such as $Ba_3Al_2O_6$ can be eliminated from cathode processing.

It has now been found that a long life high current density cathode can be made from a mixture of aluminum oxide and tungsten oxide powders in a molar ratio of 1:3 by fusing the mixture of powders into the fused powder $Al_2(WO_4)_3$, adding barium hydride to the fused powder $Al_2(WO_4)_3$, inverting the fused powders and heating to decompose the barium hydride and obtain barium metal.

More particularly, according to the invention, a mixture of $Al_2O_3$ and $WO_3$ powders in a 1:3 molar ratio are added to a sleeve that is contained at one end in a cup. The assembly is then placed in a vacuum or inert gas furnace and the powders heated to about 1100° C. for about 5 to 15 minutes. The sleeve and powder that has now fused and formed into $Al_2(WO_4)_3$ is removed from the furnace after the furnace has cooled. Residual $Al_2(WO_4)_3$ is then cleaned from the outer parts of the sleeve using emery cloth and a jeweler's lathe. Barium hydride, $BaH_2$ is then added to the sleeve with the $Al_2(WO_4)_3$ in it and the assembly placed in an inert gas or vacuum furnace. The sleeve is then inverted and the back side of the sleeve heated to about 700° C. for about 5 to 10 minutes to decompose the barium hydride and obtain barium metal. The sleeve with the $Al_2(WO_4)_3$ and barium metal in it are allowed to cool and any barium metal that may have splattered on the side of the sleeve then cleaned in an inert gas atmosphere. The sleeve with the fused $Al_2(WO_4)_3$ and barium metal are then prepared for a cathode environment by heating the sleeve under vacuum.

The sleeve used in the foregoing method can be any of those typically used in cathode technology such as molybdenum or tungsten. It is cylindrical, open ended, of any desired diameter, and can be contained at one end in a cup.

The method of the invention involves the generation of barium metal from barium hydride with the $Al_2(WO_4)_3$ on top of the barium metal. In the method, the barium diffuses through the $Al_2(WO_4)_3$ layer that is separated from the free barium metal, reacts with the $Al_2(WO_4)_3$ and forms a dipole on top of the $Al_2(WO_4)_3$ to give electron emission.

We wish it to be understood that we do not desire to be limited to the exact details of construction as described for obvious modifications will occur to a person skilled in the art.

What is claimed is:

1. Method of making a long life high current density cathode from a mixture of $Al_2O_3$ and $WO_3$ powders, said method including the steps of:

(A) adding the mixture of powders to a metal sleeve that is contained at one end in a cup, (B) placing the sleeve containing the powder into a furnace and heating the powder to about 1100° C. for about 5 to 15 minutes, (C) removing the sleeve and powder that has fused and formed into $Al_2(WO_4)_3$ from the furnace after the furnace has cooled, (D) cleaning residual $Al_2(WO_4)_3$ from the outer parts of the sleeve, (E) adding barium hydride to the sleeve containing the $Al_2(WO_4)_3$ in it in an inert atmosphere, (F) inverting the sleeve containing the $Al_2(WO_4)_3$ and heating to about 700° C. for about 5 to 10 minutes to decompose the barium hydride and obtain barium metal, (G) allowing the sleeve with $Al_2(WO_4)_3$ and barium metal to cool and cleaning any barium that may have spattered onto the side of the sleeve, and (H) preparing the sleeve with $Al_2(WO_4)_3$ and barium metal for a cathode environment by heating the sleeve under vacuum.

2. Method according to claim 1 wherein the $Al_2O_3$ and $WO_3$ are mixed in a 1:3 molar ratio.

3. Method according to claim 1 wherein the metal of the metal sleeve is selected from the group consisting of tungsten and molybdenum.

4. Method according to claim 3 wherein the metal is tungsten.

5. Method according to claim 3 wherein the metal is molybdenum.

6. Method according to claim 1 wherein in step (B), the furnace is a vacuum furnace.

7. Method according to claim 1 wherein in step (B), the furnace is an inert gas furnace.

* * * * *